US008657964B2

(12) United States Patent
Druecker et al.

(10) Patent No.: US 8,657,964 B2
(45) Date of Patent: Feb. 25, 2014

(54) METHOD OF METERING ACTIVE SUBSTANCES IN A DISHWASHER

(75) Inventors: Markus Druecker, Guetersloh (DE); Joerg Kinnius, Spenge (DE); Monika Seifert, Detmold (DE); Dirk Wegener, Bielefeld (DE); Cornelius Wolf, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 1221 days.

(21) Appl. No.: 12/096,707

(22) PCT Filed: Nov. 14, 2006

(86) PCT No.: PCT/EP2006/010887

§ 371 (c)(1),
(2), (4) Date: Jun. 9, 2008

(87) PCT Pub. No.: WO2007/065529

PCT Pub. Date: Jun. 14, 2007

(65) Prior Publication Data

US 2009/0000644 A1 Jan. 1, 2009

(30) Foreign Application Priority Data

Dec. 9, 2005 (DE) ..... 10 2005 059 343

(51) Int. Cl.
*B08B 7/04* (2006.01)

(52) U.S. Cl.
USPC ..... 134/18; 134/25.2; 134/29

(58) Field of Classification Search
None
See application file for complete search history.

(56) References Cited

U.S. PATENT DOCUMENTS

| | | | | |
|---|---|---|---|---|
| 2002/0088502 | A1 | 7/2002 | Van Rompuy et al. | |
| 2004/0163684 | A1 * | 8/2004 | Hapke | 134/57 DL |
| 2007/0144558 | A1 | 6/2007 | Classen et al. | |
| 2010/0006593 | A1 * | 1/2010 | Hellweg | 222/1 |

FOREIGN PATENT DOCUMENTS

| | | |
|---|---|---|
| DE | 3807715 | 9/1989 |
| DE | 19511789 | 10/1995 |
| DE | 19643270 | 4/1998 |
| DE | 19928040 | 12/1999 |
| DE | 10358969 | 7/2005 |
| EP | 0190795 | 8/1986 |

(Continued)

OTHER PUBLICATIONS

EPO machine translation of WO 03027377 to Gerhardt, retrieved Feb. 22, 2011.*

(Continued)

*Primary Examiner* — Eric Golightly
(74) *Attorney, Agent, or Firm* — Leydig, Voit & Mayer, Ltd.

(57) ABSTRACT

A method for dispensing a liquid or pasty cleaning agent and a liquid or pasty bleaching agent into a wash tub of a household dishwasher that includes a housing and a dispensing system disposed in the housing. The dispensing system separately stores and discharges the cleaning agent and bleaching agent. The method includes providing the dispensing system with respective reservoirs for each of the cleaning agent and the bleaching agent that have different capacities from each other. Each of the capacities are larger than needed for a single wash cycle. A first quantity of the cleaning agent and a second quantity of the bleaching agent are dispensed during a wash cycle, and the ratio of the dispensed quantities corresponds to the ratio of the capacities of the respective reservoirs.

6 Claims, 2 Drawing Sheets

(56) References Cited

FOREIGN PATENT DOCUMENTS

| | | |
|---|---|---|
| EP | 0423044 | 4/1991 |
| EP | 1329187 | 7/2003 |
| WO | 03027377 | 4/2003 |

OTHER PUBLICATIONS

EPO machine translation of Bauknecht (DE 3807715), retrieved Aug. 4, 2011.*

DE19511789 trans http://translationportal.epo.org/emtp/translate/?ACTION=description-retrieval&COUNTRY=DE&FORMAT=docdb&KIND=A1&LOCALE=en_EP&NUMBER=19511789&OPS=ops.epo.org&TRGLANG=en&ENGINE=google&SRCLANG=de and http://worldwide.espacenet.com/publicationDetails/claims?CC=DE&NR=19511789A1&KC=A1&FT=D&date=19951005&DB=EPODOC&locale=en_EP, Nov. 30, 2011.*

* cited by examiner

METHOD OF METERING ACTIVE SUBSTANCES IN A DISHWASHER

CROSS REFERENCE TO RELATED APPLICATIONS

This is a U.S. National Phase application under 35 U.S.C. §371 of International Application No. PCT/EP2006/010887, filed on Nov. 14, 2006, and claims the benefit of German Patent Application No. 10 2005 059 343.7, filed on Dec. 9, 2005. The International Application was published in German on Jun. 14, 2007 as WO 2007/065529 A1 under PCT Article 221(2)

FIELD

The present invention relates to a method for dispensing cleaning agent and bleaching agent into the washing tub of a household dishwasher including a housing and at least one dispensing system which is disposed within the housing and used for separately storing and discharging a liquid or pasty cleaning agent and a liquid or pasty bleaching agent.

BACKGROUND

The household dishwashers described in EP 1 329 187 A2 includes dispensing systems that are adapted to store a relatively large quantity of liquid rinse aid, a fraction of this quantity then being dispensed into the washing tub during each wash cycle. DE 199 28 040 A1 also describes dispensing systems which also allow storage of liquid aftertreatment agents therein. These dispensing systems are additionally provided with a receiving compartment which is filled with detergent in the form of powder or tabs for each dishwashing cycle, and which is then emptied into the washing tub by the cycle controller during the appropriate cycle step. It is considered to be a disadvantage of these devices that the user must fill detergent into the receiving compartment for each wash cycle. Another disadvantage is that the dispensing of the detergent is performed by the user himself/herself, either based on a rough estimate of the quantity actually needed (when using powder) or without any possibility of dispensing variable amounts (when using tabs).

Storing relatively large quantities of detergent tabs or powder in the inflow region of the washing tub of a dishwasher has proved not to be practical because moisture and increases in temperature cause such agents to clump together, as a result of which they can no longer be dispensed automatically, or are caused to adhere in their reservoirs or to be impaired in their effectiveness.

Industrial cleaning and sanitizing appliances described in DE 196 43 270 A1, include a dispensing pump that supplies a particular needed quantity of an active substance from a retail container to the washing tub of the appliance. Using retail containers is not practical because such containers require additional space inside or outside the appliance to accommodate them. Moreover, an agent suitable for use in household dishwashers and intended to have the same cleaning properties as conventional powders or tabs cannot be stored in a liquid or pasty formulation. The reason for this is that the enzymes needed to degrade starch and proteins are sensitive to oxidizing agents, such as are needed in an effective bleaching system. In liquid or pasty media, these opponents cannot be separated as effectively as in detergent powders or tabs.

German Patent Document DE 103 58 969 A1 describes a dishwasher having a dispensing device in which relatively large quantities of so-called basic chemicals can be stored.

The bleaching agent needed for the dishwashing process is here in the form of active chlorine gas which is generated in a microreactor. The use of chlorine gas causes the development of unpleasant odors, and when used in larger quantities, chlorine gas is even toxic.

German Patent Document DE 195 11 789 A1 describes a washing machine or dishwasher having a dispensing chamber with an adjustable volume.

German Utility Model DE 85 02 661 U1 describes a device for supplying cleaning agents in dishwashers, said device including two separate reservoirs for storing cleaning agents. This allows cleaning agent to be dispensed in the prewash cycle and in the wash cycle. The reservoirs have different capacities, the ratio of the capacities being 1:2.

SUMMARY

In view of the above, an aspect of the present invention is to provide a method for dispensing cleaning and bleaching agents in a household dishwasher, in which relatively large quantities of detergent can be stored and automatically dispensed when appropriate.

In an embodiment, the present invention provides a method for dispensing a liquid or pasty cleaning agent and a liquid or pasty bleaching agent into a wash tub of a household dishwasher that includes a housing and a dispensing system disposed in the housing. The dispensing system separately stores and discharges the cleaning agent and bleaching agent. The method includes providing the dispensing system with respective reservoirs for each of the cleaning agent and the bleaching agent that have different capacities from each other. Each of the capacities are larger than needed for a single wash cycle. A first quantity of the cleaning agent and a second quantity of the bleaching agent are dispensed during a wash cycle, and the ratio of the dispensed quantities corresponds to the ratio of the capacities of the respective reservoirs.

BRIEF DESCRIPTION OF THE DRAWINGS

An exemplary embodiment of the present invention will be described in more detail below and is shown in a purely schematic way in the drawings, in which.

DETAILED DESCRIPTION

Figure 1:
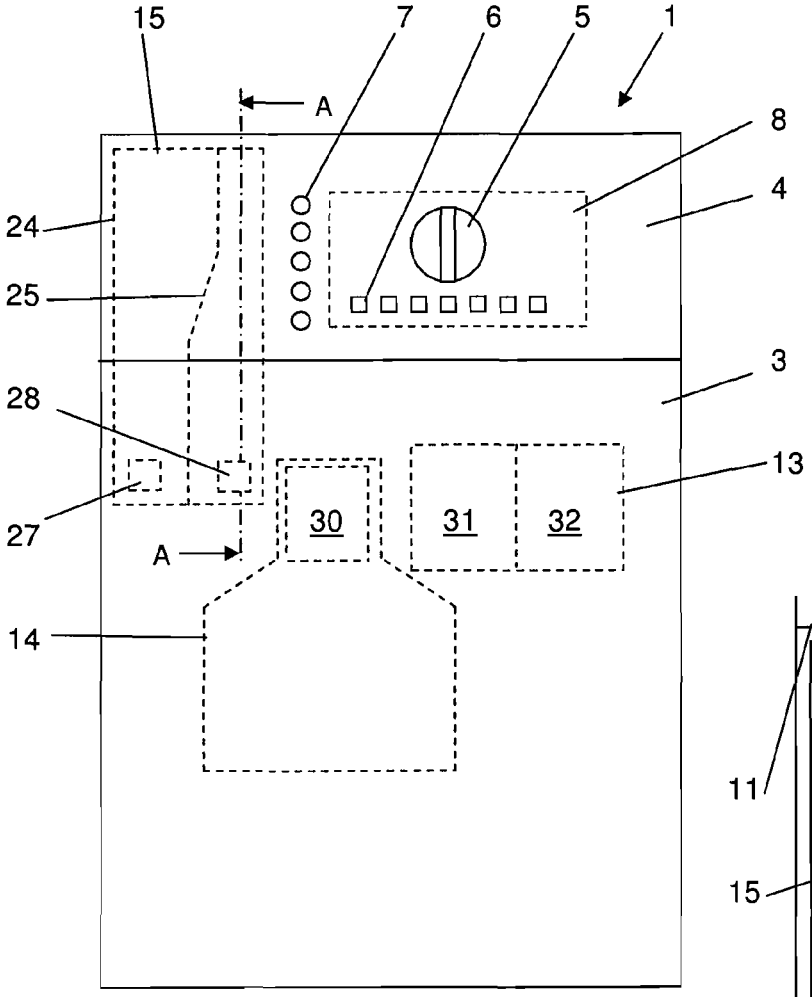
FIG. 1 is a schematic view of the front side of a household dishwasher configured in accordance with the present invention.

In an embodiment of the present invention, the dispensing system is adapted to separately store and discharge a liquid or pasty cleaning agent and a liquid or pasty bleaching agent, and, for this purpose, the dispensing system is provided with reservoirs whose capacities are larger than would be necessary to hold the quantity of cleaning agent and bleaching agent needed for a single wash cycle, respectively.

In another embodiment, the present invention provides a method for dispensing such a detergent, which will simplify the refilling process. According to the present invention, this object is achieved in that the cleaning agent and the bleaching agent are dispensed during a wash cycle in quantities whose ratio is equal to the ratio of the capacities of the reservoirs.

In addition to increasing the ease of handling, the present invention allows the detergent quantity to be automatically adjusted to the soil level of the dishes, to the dish load and/or to the particular wash cycle selected. Moreover, separate storage of the cleaning and bleaching components has the advantage that said components can be dispensed at different times and in different quantities, so that they can then deliver high-quality performance in the respective cycle steps.

In an embodiment, the reservoirs are disposed in the upper portion of an appliance door closing the washing tub, which makes it easier to fill them.

In another embodiment, the reservoirs may be insulated from the washing tub. This prevents the components from being excessively exposed to the temperature variations in the washing tub, which could impair their performance.

In order to implement an automatic, program-controlled dispensing method in a simple manner, the reservoirs may connect to downstream dispensing chambers, the communication passages between the reservoirs and the dispensing chambers in each case being able to be cut off from each other by first sealing element or obturating means. Each time these sealing elements are opened, defined quantities are introduced into the respective dispensing chambers, said quantities being subsequently discharged through outlet ports of the dispensing chambers by opening second sealing elements. In one embodiment the respective first and second sealing elements can be coupled in such a manner that closure of a communication passage will cause an outlet port to open, and that the opening of a communication passage will cause an outlet port to close. Thus, only one actuator is needed per reservoir to move the first and second sealing elements. It is even possible to couple the sealing elements of both reservoirs, and thus to allow another actuator to be eliminated. Disadvantageously, however, this would make it impossible for the two components to be dispensed independently of each other in terms of time or quantity.

The sealing elements may be movable by electric motor means or electromagnetic means.

When using a device for producing at least one liquid jet in the dishwasher, the second sealing element may be disposed in the area of incidence of the liquid jet. This provides for cleaning of the sealing elements, thereby ensuring sealing engagement thereof In an embodiment, the capacity of a dispensing chamber is a fraction of the maximum quantity of active substance dispensed during a wash cycle. Thus, a variable quantity of active substance which is adjusted, for example, to the soil level of the dishes, to the dish load and/or to the particular wash cycle selected can be fed to the dishwashing process by repeated operation of the dispensing system.

Further, the reservoirs may have different capacities. This makes it possible to take into account that the amount of bleaching agent needed for a dishwashing process is less than the required amount of cleaning agent. This is where the method for dispensing cleaning agent and bleaching agent according to claim 11 comes in. Because the cleaning agent and the bleaching agent are dispensed during a wash cycle in quantities whose the ratio is equal to the ratio of the capacities of the reservoirs, it is ensured that both reservoirs are always be empty at the same time and that, therefore, they can be refilled in a single operation.

The present invention relates to a household dishwasher including a housing in which is disposed a washing tub, and further including at least one dispensing system which is disposed within the housing and used for adding an active substance into the washing tub in a program-controlled manner. The present invention also relates to a method for dispensing cleaning agent and bleaching agent into the washing tub of a household dishwasher including a housing and at least one dispensing system which is disposed within the housing and used for separately storing and discharging a liquid or pasty cleaning agent and a liquid or pasty bleaching agent, for which purpose the dispensing system is provided with reservoirs having different capacities, said capacities being larger than would be necessary to hold the quantity of cleaning agent and bleaching agent needed for a single wash cycle, respectively.

Figure 2:
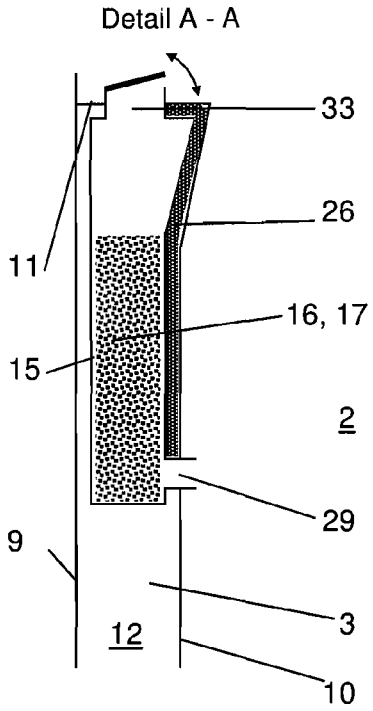
FIG. 2 is a cross-sectional view through the upper portion of the appliance door of the household dishwasher shown in FIG. 1.

FIG. 1 shows the front side of a household dishwasher 1, which includes a washing tub 2 which is open at the front and can therefore be closed by a hinged appliance door 3. This figure shows the appliance with the door 3 closed. Therefore, washing tub 2, which is fragmentarily shown in FIG. 2, cannot be seen in FIG. 1. The upper portion of door 3 may accommodate a control panel 4 containing a rotary selector switch 5 and/or push buttons 6 for cycle selection and further containing indicators 7 used to display information to the user. An appliance controller 8 and further electrical and electronic components are disposed inside the control panel, which is symbolized by the dashed-line box. As can be seen in FIG. 2, door 3 is formed of an outer door panel 9 and an inner door panel 10. Inner door panel 10 has a folded edge 11, so that a closed hollow body 12 is formed when outer door panel 9 and inner door panel 10 are assembled together. The dispensing systems and reservoirs, which will be described hereinafter, are disposed within this hollow body 12, and are therefore indicated as dashed-line shapes. The valves, hose connections, and electrical wires, etc., which are also needed, are not the subject matter of the present invention and are therefore not shown here. The middle portion of the door accommodates a so-called combination dispenser 13 (see, for example, EP 1 329 187 A2), said combination dispenser being capable of receiving powdered detergent or detergent tabs for one wash cycle and of receiving rinse aid for several wash cycles. There may also be provided a salt container to receive the water softener salt necessary to regenerate a water softener. In accordance with the present invention, a further dispensing system 15 is disposed in the upper left half of appliance door 15.

Figure 3B:
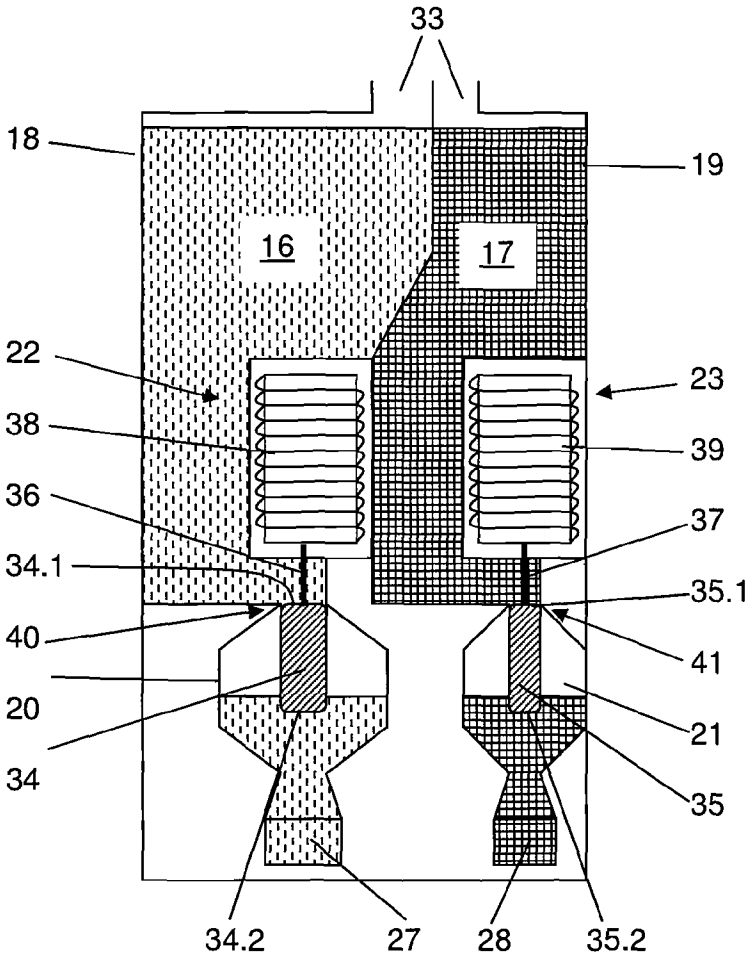
FIGS. 3*a, b* are detail views showing the dispensing system for cleaning agent and bleaching agent during the filling of the dispensing chambers (FIG. 3*a*) and during the emptying of the dispensing chambers (FIG. 3*b*).
Figure 3A:
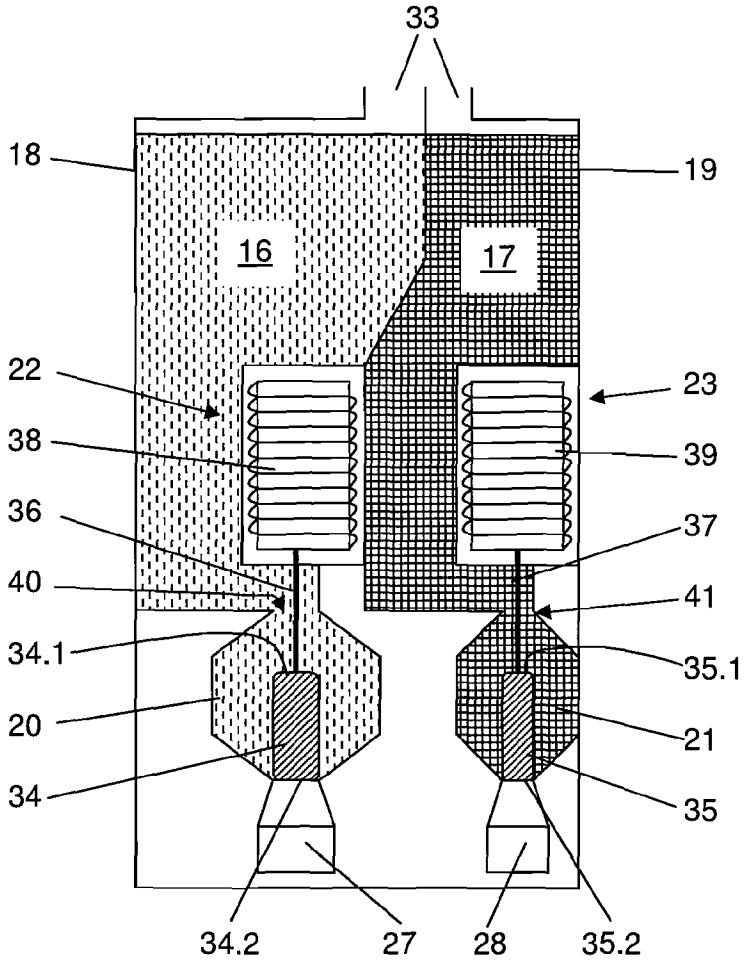

Further dispensing system 15 is capable of discharging liquid or pasty cleaning agent 16 and liquid or pasty bleaching agent 17 in a program-controlled manner (see FIGS. 3*a* and *b*). The active components are stored separately in two different reservoirs 18 and 19. Thus, the enzymatic/alkaline and bleaching components, which are incompatible in liquid and/or pasty formulations, are not mixed until they are in the washing tub, where they can then produce their full effect.

In the exemplary embodiment shown, the further dispensing system is provided in addition to combination dispenser 13, so that the user can choose between conventional detergent powders or tabs and liquid components. In a less convenient embodiment, combination dispenser 13 can be dispensed with. In this case, however, dispensing system 15 must additionally be provided with a chamber for rinse aid.

As can be seen in FIG. 3, dispensing system 15 is constituted by the two reservoirs 18 and 19 and the dispensing chambers 20 and 21 integrally formed therewith, said dispensing chambers each having a closure device 22 or 23 associated therewith, respectively. The dispensing system may be manufactured from plastic as a single part. In this case, a common housing 24 is divided by a partition 25 into the two reservoirs 18 and 19. Alternatively, the two reservoirs 18 and 19 can be made as separate components. Dispensing system 15 is mounted in hollow space 12 between outer panel 9 and inner panel 10. Reservoirs 18 and 19 are enclosed by a thermal insulation layer 26, at least on the side facing washing tub 2. Alternatively, the reservoir walls may all be manufactured from a thermally insulating material. Outlet ports 27 and 28, which are used for dispensing the media 16 and 17, are in the form of channels 29 (see FIG. 2) which penetrate inner door panel 10 approximately at the height of the inlet valves 30 through 32 of salt container 14 and combination dispenser 13. The filling openings are similarly formed as channels 33 and extend through folded edge 11 of inner door panel 10, so that reservoirs 18 and 19 can be easily filled when appliance door 3 is slightly open. A mechanism may retain the door in this slightly open position, so that the user has both hands free for filling.

The closure devices include plungers 34 and 35, which are each movable by rods 36 and 37 of solenoids 38 and 39 between a first position shown in FIG. 3*a* and a second position shown in FIG. 3*b*. Upper ends 34.1 and 35.1 of plungers 34 and 35 are rounded, thus providing upper sealing surfaces capable of closing the communication passages 40 and 41 between reservoirs 18 and 19 and dispensing chambers 20 and 21, as shown in FIG. 3*b*. Lower ends 34.2 and 35.2 are also rounded and provide lower sealing surfaces capable of closing the inlets of channels 29 and thereby the outlet ports 27 and 28 to washing tub 2 (see FIG. 3*a*). External to the dispensing process, plunger 34 remains in a lowered position, with its lower sealing surface 34.2 closing outlet port 27. Thus, reservoir 18 is open to dispensing chamber 20, as a result of which dispensing chamber 20 is filled. In order to carry out the dispensing operation, plunger 34 is lifted, so that upper sealing surface 34.1 closes communication passage 40, stopping the flow of medium 16 into dispensing chamber 27. In this process, lower sealing surface 34.2 is simultaneously removed from the channel inlet, thereby opening outlet port 27. Thus, the supply of cleaning agent 16 present in dispensing chamber 20 is discharged into washing tub 2. The dispensing of bleaching agent 17 from reservoir 19 through closure device 23 is accomplished in an analogous manner.

Outlet ports 27 and 28 should be positioned such that are hit by a spray jet from one of the spray arms (for example, from the middle spray arm, which is not shown). This allows the sealing seat between the outlet and dispensing chambers 20 and 21 to be cleaned by the spray jets. The spray jets may even partially wash out dispensing chambers 20 and 21.

It can be seen in FIGS. 3*a* and *b* that the right reservoir 19 used for bleaching agent 17 and right dispensing chamber 21 have a smaller volume than their left neighbors. This is due to the fact that the quantity of bleaching agent 17 needed for a wash cycle is less than quantity of cleaning agent 16 needed for a wash cycle. If dispensing chambers 20 and 21 and reservoirs 18 and 19 are sized such that the ratio of the two reservoirs 18 and 19 is exactly equal to the ratio of dispensing chambers 20 and 21 and if, in addition, the same number of dispensing operations is performed for cleaning agent 16 and for bleaching agent 17 during each wash cycle, it is thereby ensured that the two reservoirs 18 and 19 are empty at the same time.

Furthermore, dispensing chambers 20 and 21 are sized to have a capacity that is only a fraction of the maximum quantity of active substance dispensed during a wash cycle.

This makes it possible to repeatedly dispense such a fraction during the course of a wash cycle. Thus, first of all, the quantity of cleaning agent dispensed can be varied according to either the selected cycle and/or according to sensed parameters of the items to be washed and/or of the wash water. Thus, cleaning agent use can be configured according to the dish load, according to the soil level, or according to the wash cycle, for example, by measuring the turbidity of the wash water using a suitable turbidity sensor (not shown). Secondly, the fractions can be supplied to the washing tub during different phases of the wash cycle. Moreover, in order to be able to counter the deterioration in the cleaning or bleaching power of the agents 16 and 17 used, the quantities to be dispensed may be increased as the fill level of reservoirs 18 and 19 decreases. In this case, at least one level sensor (not shown in the figures) or a device for detecting an empty condition or the refilling of a reservoir is needed. In the latter two cases, it is additionally required to count the number of dispensing operations already performed.

Contact of the (highly) concentrated individual cleaning or bleaching agent components with the skin of the user may cause allergic reactions. In order to avoid this, it is necessary to prevent leakage of medium during the filling of the reservoirs. This can be achieved, for example, in that the refill container is opened by a mating component on the reservoir in such a manner that the closure is unlocked only when properly positioned (not shown). This may be achieved using the known self-sealing coupling principle used in compressed air systems.

Since the enzymatic/alkaline and/or bleaching components have different viscosities, which may vary from thin to honey-like, the dispensing mechanism must be able to provide for reliable flow into and out of dispensing chambers 20 and 21 for all viscosities. This can be accomplished by the following measures, which may be used alone or in combination:

- providing communication passages 40, 41 and outlet ports 27, 28 with a large free area;
- providing sufficient stroke length for plungers 34 and 35;
- providing the surface of plungers 34 and 35 with ribs, which may, in particular, be helical in shape, whereby media 16 and 17 to be dispensed are set into motion (not shown);
- rotating plungers 34 and 35 about their axes of stroke during the stroke movement;
- configuring the sealing elements 34.1, 34.2, 35.1 and 35.2 such that they have an inclined sealing plane, which allows air bubbles to accumulate at a defined position in a controlled manner.

What is claimed is:

1. A method for dispensing a liquid or pasty cleaning agent and a liquid or pasty bleaching agent into a wash tub of a household dishwasher, the dishwasher including a housing and at least one dispensing system disposed in the housing and configured to separately store and discharge a cleaning agent and a bleaching agent, both the cleaning agent and bleaching agent being at least one of liquid and pasty, the method comprising:

providing the dispensing system with respective first and second reservoirs for each of the cleaning agent and the bleaching agent, the respective first and second reservoirs having different capacities from each other, each capacity being larger than a respective quantity for a single wash cycle;

providing the dispensing system with a first dispensing chamber downstream of the first reservoir and a second dispensing chamber downstream of the second reservoir;

filling the first dispensing chamber with a first quantity of the cleaning agent from the first reservoir, closing a passage between the first dispensing chamber and the first reservoir, and dispensing the first quantity of cleaning agent from the first dispensing chamber during a wash cycle, the first quantity being less than the capacity of the first reservoir; and filling the second dispensing chamber with a second quantity of bleaching agent from the second reservoir, closing a passage between the second dispensing chamber and the second reservoir, and dispensing the second quantity of bleaching agent from the second dispensing chamber, the second quantity being less than the capacity of the second reservoir and a ratio of the first and second quantities being substantially equal to a ratio of the capacities of the respective first and second reservoirs.

2. The method as recited in claim 1 wherein at least one of the first and second quantities is dependent upon a selected cycle of the washing machine.

3. The method as recited in claim 1 wherein at least one of the first and second quantities is dependent upon a sensed parameter of an item to be washed.

4. The method as recited in claim 1 wherein at least one of the first and second quantities is dependent upon a sensed parameter of the wash water.

5. The method as recited in claim 1 wherein the dishwasher includes an appliance door configured to close the washing tub, the first and second reservoirs being disposed in an upper portion of the appliance door.

6. The method as recited in claim 1 wherein the first and second reservoirs are thermally insulated from the washing tub.

* * * * *